US007238060B1

(12) United States Patent
Lee et al.

(10) Patent No.: US 7,238,060 B1
(45) Date of Patent: Jul. 3, 2007

(54) RECEPTACLE CONNECTOR HAVING TERMINALS WITH LOCATING PROJECTIONS EXTENDING IN OPPOSITE DIRECTIONS

(75) Inventors: Shih-An Lee, Tu-Cheng (TW); Kuo-Chin Lin, Tu-Cheng (TW); Kai-Hsiang Chang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/453,900

(22) Filed: Jun. 16, 2006

(51) Int. Cl.
*H01R 24/00* (2006.01)

(52) U.S. Cl. ..... 439/676; 439/941

(58) Field of Classification Search ..... 439/676
See application file for complete search history.

(56) References Cited

U.S. PATENT DOCUMENTS 4,274,691 A * 6/1981 Abernethy et al. ..... 439/507
5,419,720 A * 5/1995 Chen ..... 439/676
5,586,914 A * 12/1996 Foster et al. ..... 439/676
6,155,881 A * 12/2000 Arnett et al. ..... 439/676
6,402,563 B1 * 6/2002 Shi et al. ..... 439/676
6,413,121 B1 * 7/2002 Hyland ..... 439/676
6,764,336 B2 * 7/2004 Ma et al. ..... 439/604
7,001,221 B2 * 2/2006 Chen ..... 439/676
2005/0009410 A1 * 1/2005 Cheng et al. ..... 439/676

* cited by examiner

*Primary Examiner*—Hae Moon Hyeon
(74) *Attorney, Agent, or Firm*—Birch, Stewart, Kolasch & Birch, LLP

(57) ABSTRACT

A receptacle connector includes a body, a cover assembled outside the body and a terminal module received in the body. The terminal module comprises a plurality of terminals and a pedestal. Each terminal defines a fixing portion. The fixing portion stretches sideward and forms a pair of locating projections. The pedestal further comprises an upper and a lower board. Both the upper and the lower board define a plurality of terminal channels and locating cavities. The fixing portion of the terminal is received in the terminal channel. The locating projection of the terminal is received and fixed in the locating cavity. The sides of the pedestal protrude sideward to form a pair of inserting portion. Accordingly, the body defines a receiving cavity to receive the terminal module. The body also defines a pair of receiving channels in sides of the receiving cavity for receiving the inserting portion of the pedestal.

10 Claims, 7 Drawing Sheets

RECEPTACLE CONNECTOR HAVING TERMINALS WITH LOCATING PROJECTIONS EXTENDING IN OPPOSITE DIRECTIONS

BACKGROUND OF THE INVENTION

1. Field of the Invention

The present invention relates to a receptacle connector, and particularly to a receptacle connector with mechanisms for easily assembling the terminals.

2. The Related Art

A receptacle connector is commonly used in electronic devices such as network equipments and telephones. The receptacle connector usually includes a terminal module to communicate with a plug connector.

A conventional receptacle connector includes a body and a plurality of terminals fixed in the body. The conventional receptacle connector usually uses an inserting mold to fix the terminals into the body. That is to say, in order to fix the terminals in the body, a plurality of terminals should be firstly fixed in the mold before the body is formed. And then, the terminals are formed in the body and can't be taken apart from the body.

However, while the terminals are fixed in the mold, the precise position of the terminal is difficult to control. This usually causes further a trouble in assembling or using of such receptacle connector, such as a disconnection between the terminals of the receptacle and plug connector.

SUMMARY OF THE INVENTION

Accordingly, an object of the present invention is to provide a receptacle connector which includes a body, a cover assembled outside the body and a terminal module received in the body. The terminal module includes a pedestal and a plurality of terminals received in the pedestal. The terminal defines a fixing portion. The fixing portion of the terminal stretches sideward to form a pair of locating projections. The pedestal of the terminal module further defines an upper and a lower board. Both the upper and the lower board define a plurality of terminal channels and locating cavities. The fixing portion of the terminal is received in the terminal channel of the pedestal. The locating projection of the terminal is respectively received and fixed in the locating cavity of the pedestal. The sides of the pedestal protrude sideward to form a pair of inserting portions. Accordingly, the body defines a receiving cavity to receive the terminal module. The body defines a pair of receiving channels in sides of the receiving cavity for receiving the inserting portion of the pedestal.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
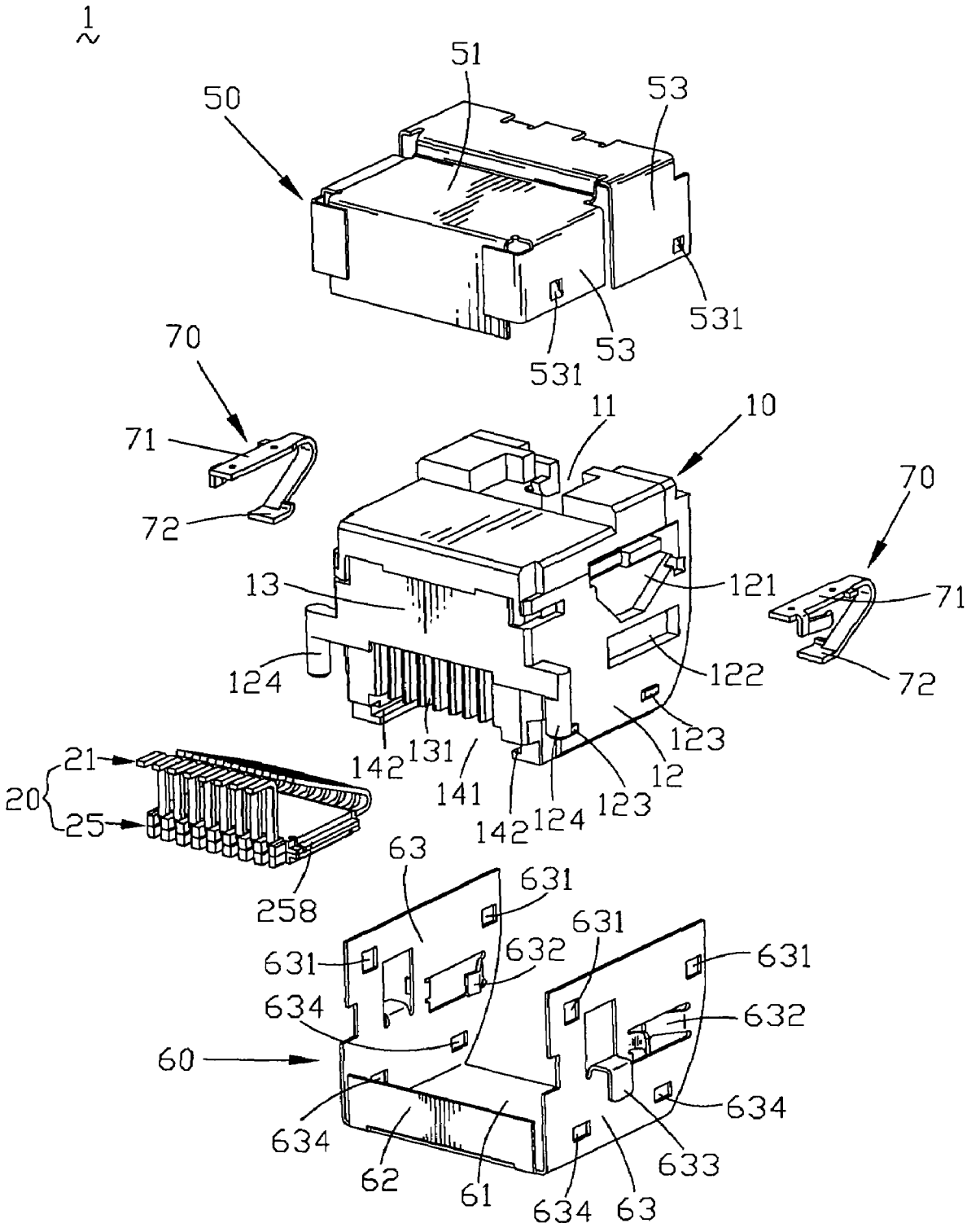
FIG. 1 is a perspective exploded view of a receptacle connector according to the present invention.

Referring to FIG. 1, showing an embodiment of a receptacle connector 1 in accordance with the present invention, the receptacle connector 1 includes a body 10 defining a receiving space 11, a terminal module 20 received in the body 10, a cover further including a bottom cover 60 and a top cover 50 assembling outside the body 10, and a plurality of pressing pins 70 fixed in the body 10 and stretching into the receiving space 11.

Figure 2:
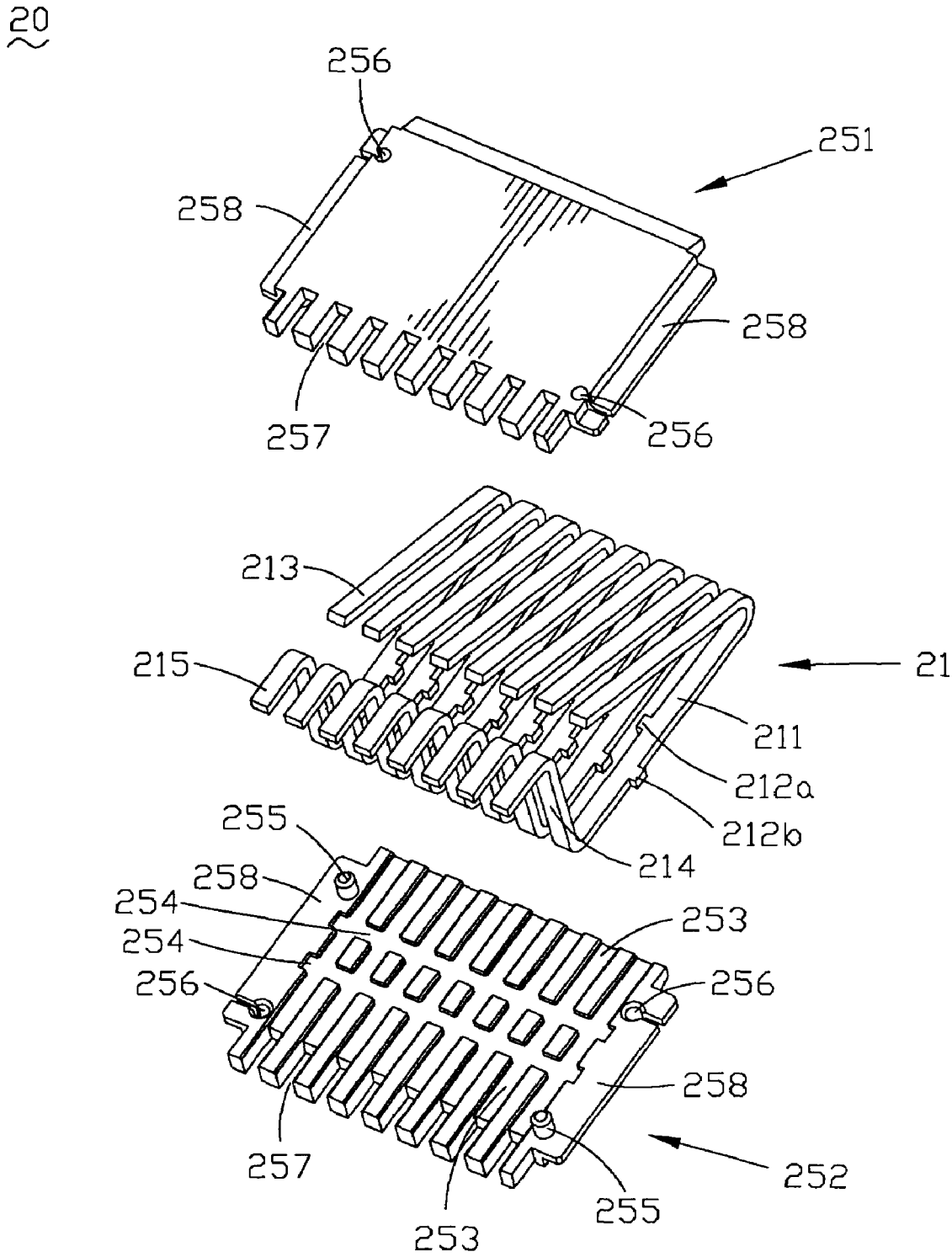
FIG. 2 is a perspective exploded view of the terminal module.

As shown in FIG. 2, the terminal module 20 includes a plurality of terminals 21. Each terminal 21 defines a fixing portion 211. The fixing portion 211 of the terminal 21 stretches sideward to form a pair of locating projections 212*a* and 212*b*. The front of the fixing portion 211 is bent backwardly and stretches up to form an inclined contacting portion 213. The back of the fixing portion 211 is bent up to form a holding portion 214. The top of the holding portion 214 is bent backwardly and forms a soldering portion 215 for soldering to an external printed circuit board (PCB, not shown).

Figure 3:
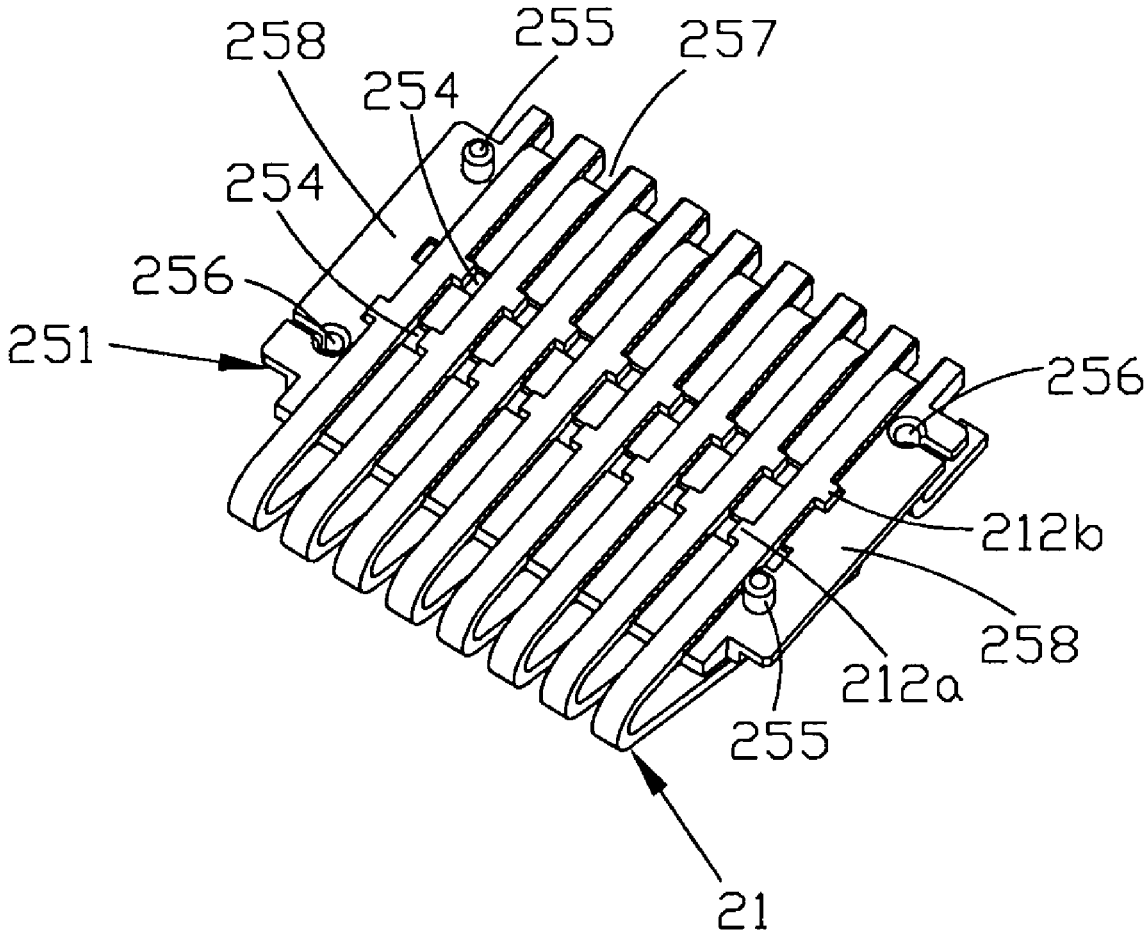
FIG. 3 is a perspective view of the upper board of the pedestal assembled with the terminals.

Referring to FIGS. 2 and 3, the pedestal 25 of the terminal module 20 further comprises an upper board 251 and a lower board 252. Both the upper board 251 and the lower board 252 define a plurality of terminal channels 253. The terminal channels 253 are paralleled to each other for receiving the fixing portions 211 of the terminals 21. So, a rib is formed between the adjoined terminal channels 253. Both the upper board 251 and the lower board 252 also define a plurality of locating cavities 254 from the side of each terminal channel 253 communicating with the adjoined terminal channels 253 for receiving the locating projections 212*a* and 212*b* of the terminals 21. The back portion of the upper board 251 defines a plurality of breaches 257 for allowing the holding portion 214 passing through. The left side of the lower board 252 defines a pillar 255 in the front and a locking hole 256 in the rear. Correspondingly, the right side of the lower board 252 defines a locking hole 256 in the front and a pillar 256 in the rear. The lower board 252 stretches sideward to form a pair of inserting portions 258. The inserting portion 258 is thicker than the lower board 252. The inserting portion 258 and the lower board 252 have a same top surface. And a step is formed between the bottom surface of the inserting portion 258 and the bottom surface of the lower board 252. The upper board 251 has the same mechanisms with the lower board 252 and is just an overturning of the lower board 252. That is to say, the left side of the upper board 251 defining a locking hole 256 in the front and a pillar 255 in the rear, the right side of the upper board 251 defining a pillar 255 in the front and a locking hole 256 in the rear. The pillars 255 respectively lock with the locking holes 256 to further achieve a locking of the top board 251 and the lower board 252. The upper board 251 also stretches sideward to form a pair of inserting portions 258. The inserting portion 258 is thicker than the upper board 251. The inserting portion 258 and the upper board 251 have a same bottom surface. And a step is formed between the top surface of the inserting portion 258 and the top surface of the upper board 251.

Figure 4:
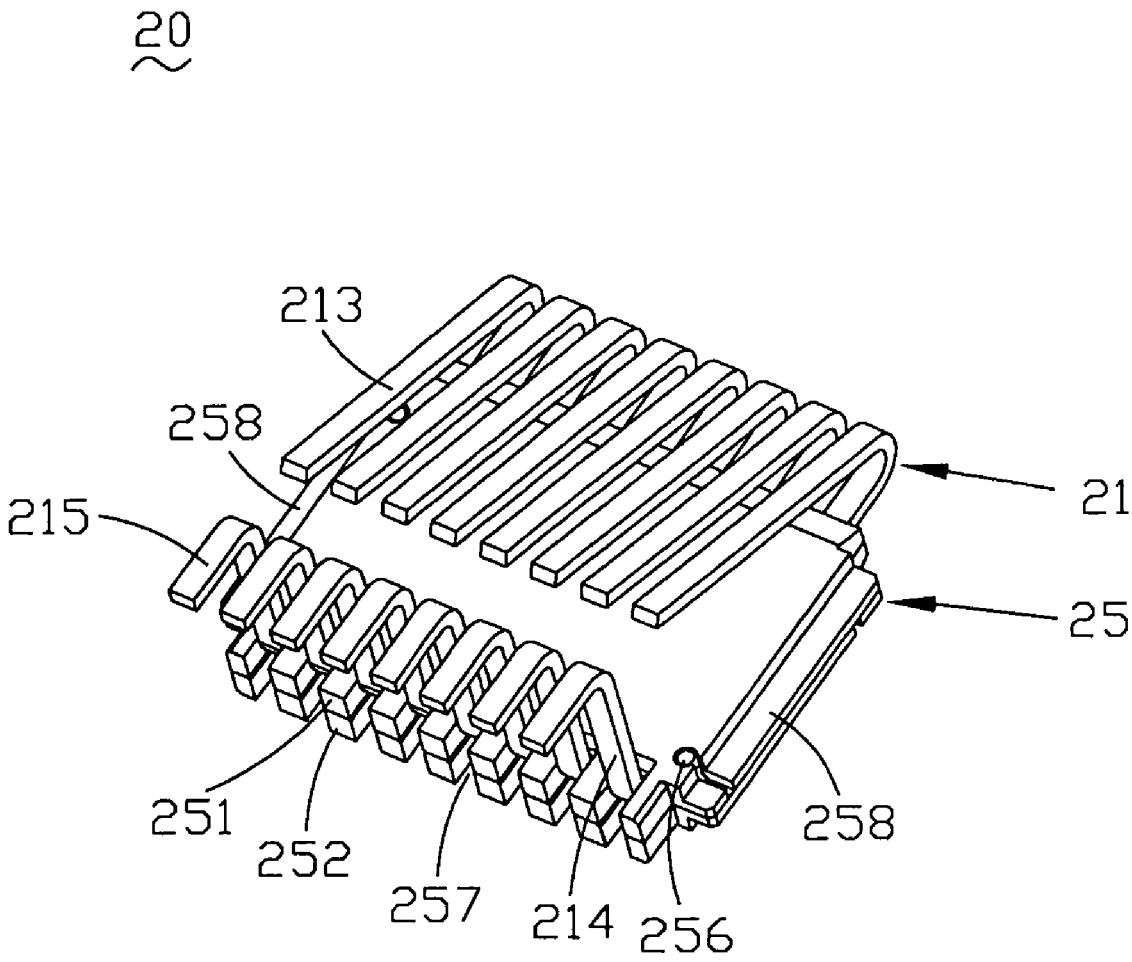
FIG. 4 is a perspective view of the terminal module.
Figure 5:
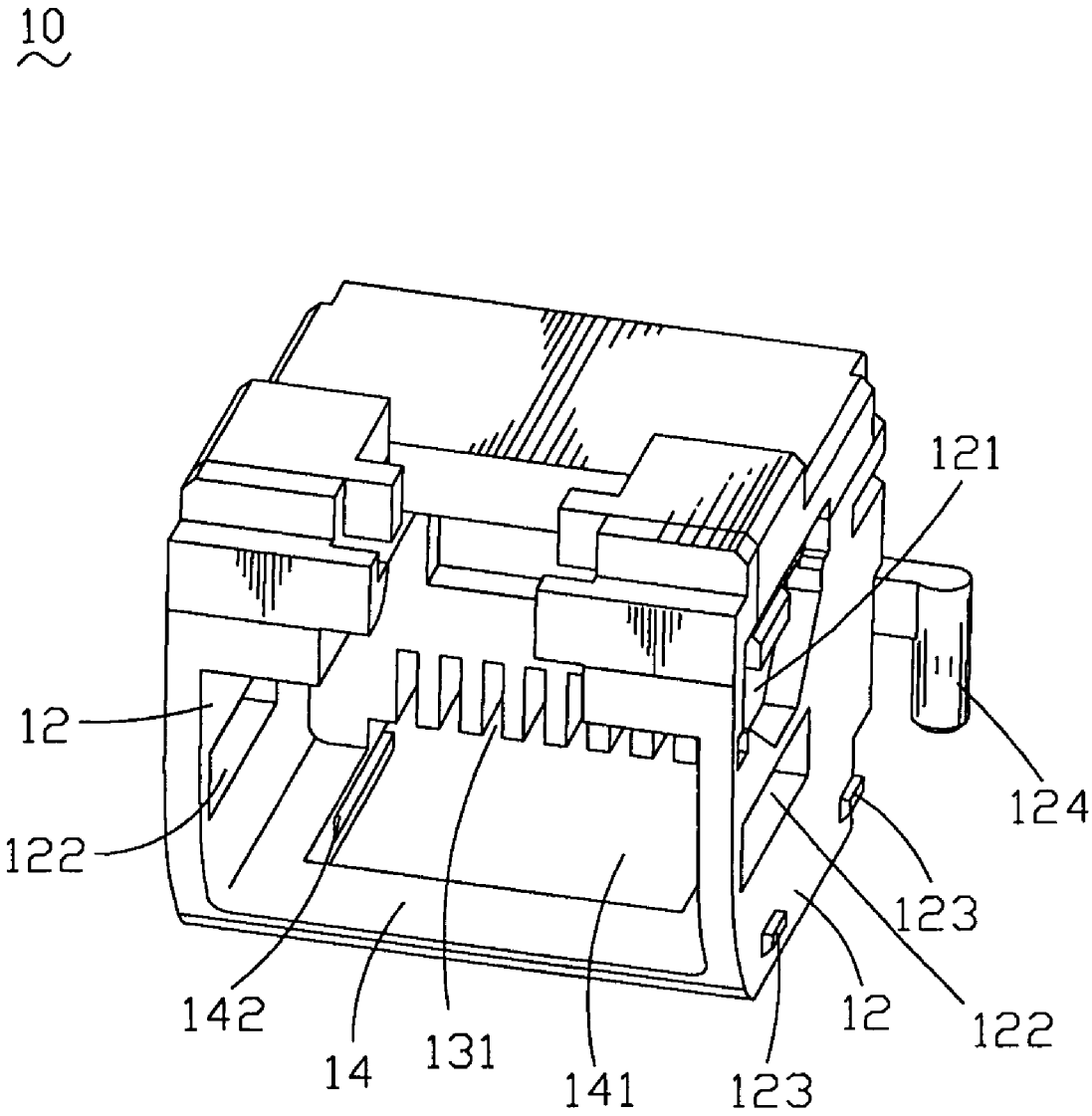
FIG. 5 is a perspective view of the body of the receptacle connector.
Figure 6:
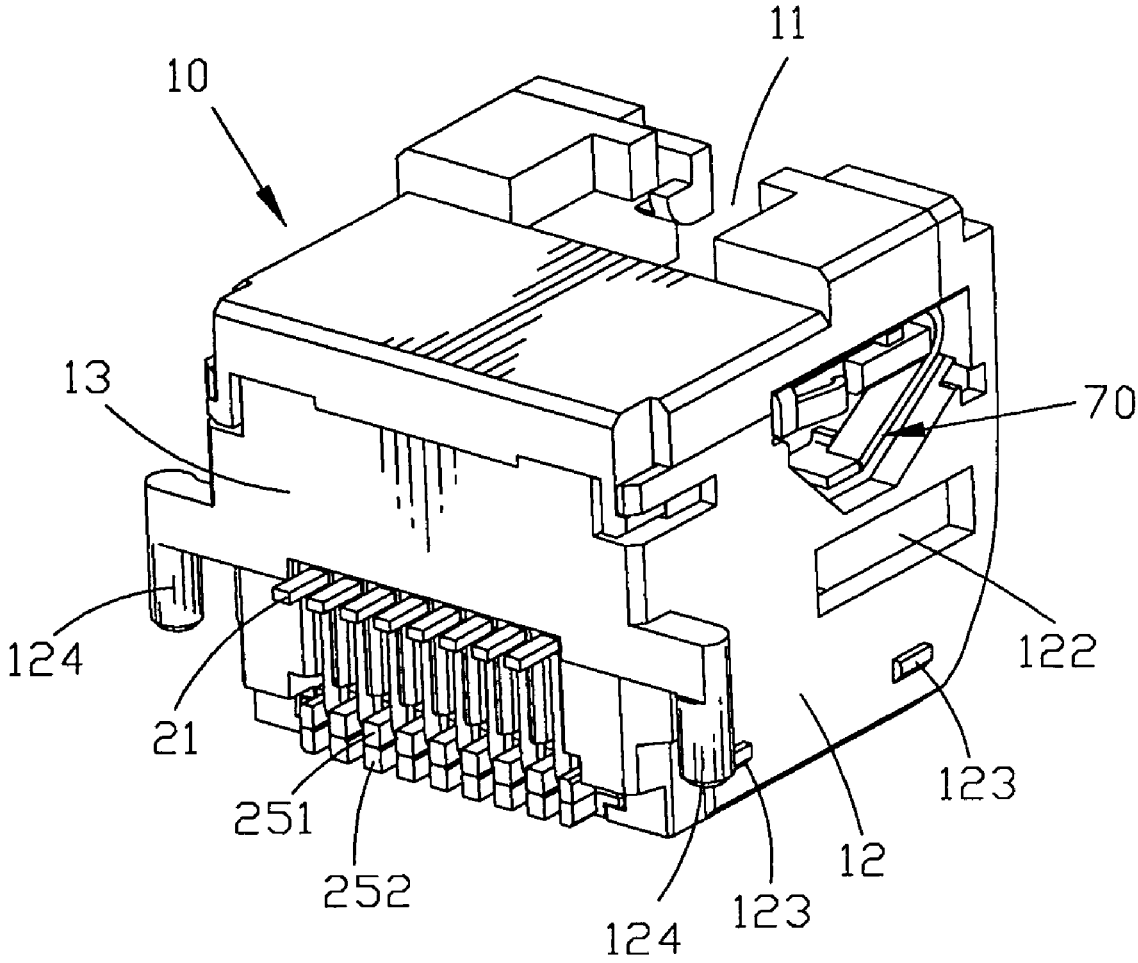
FIG. 6 is a perspective view of the body assembled with a pair of pressing pins and the terminal module.

As shown in FIG. 1 and FIG. 4, the body 10 defines a pair of side walls 12. Each side wall 12 defines a trapezoid hole 121 in the top portion and an oblong hole 122 below the trapezoid hole 121. Both the trapezoid hole 121 and the oblong hole 122 communicate with the receiving space 11. Both the trapezoid hole 121 and the oblong hole 122 communicate with the receiving space 11. The bottom portion of each side wall 12 defines a pair of fixing lumps 123. The back of the side wall 12 stretches sideward to form a fixing column 124 for fixing in the external PCB. As shown in FIG. 5, the bottom of the body 10 defined s bottom wall 14. The bottom wall 14 defines a receiving cavity 141 for receiving the pedestal 25 of the terminal module 20. The bottom wall 14 also defines a pair of inserting cavity 142 in the side of the receiving cavity 141 for receiving the inserting portion 258 of the pedestal 25. The back of the body 10 defines a back wall 13. The back wall 13 defines a plurality of terminal holes 131 in the bottom portion for allowing the terminals 21 passing through.

Referring to FIG. 1 again, the bottom cover 60 defines a bottom board 61. The bottom board 61 is bent upwardly from the rear to form a back board 62. The bottom board 61 stretches upwardly from the side to form a pair of first side boards 63. The top portion of each first side board 63 defines a pair of first fixing hole 631. Below the first fixing hole 631, a pressing piece 632 is defined stretching inward the bottom cover 60 for coupling with the oblong hole 122 of the body 10. Behind the pressing piece 632, the side board 63 defines a fixing piece 633 stretching downwardly for fixing to the external PCB. Bellow the pressing piece 632 and the fixing piece 633, a pair of second fixing hole 634 is formed to lock the fixing lumps 123 of the body 10.

Please refer to FIG. 1. The top cover 50 defines a top board 51. The top board 51 is bent downwardly from the sides to form a pair of second side boards 53. The second side board 53 defines a pair of locking pieces 531 for coupling with the first fixing hole 631.

As shown in FIG. 1, the pressing pin 70 defines a horizontal portion 71. The horizontal portion 71 is bent down and stretches backward from the front portion to form a pressing plane 72 for pressing a top surface of a plug connector (not shown).

Figure 7:
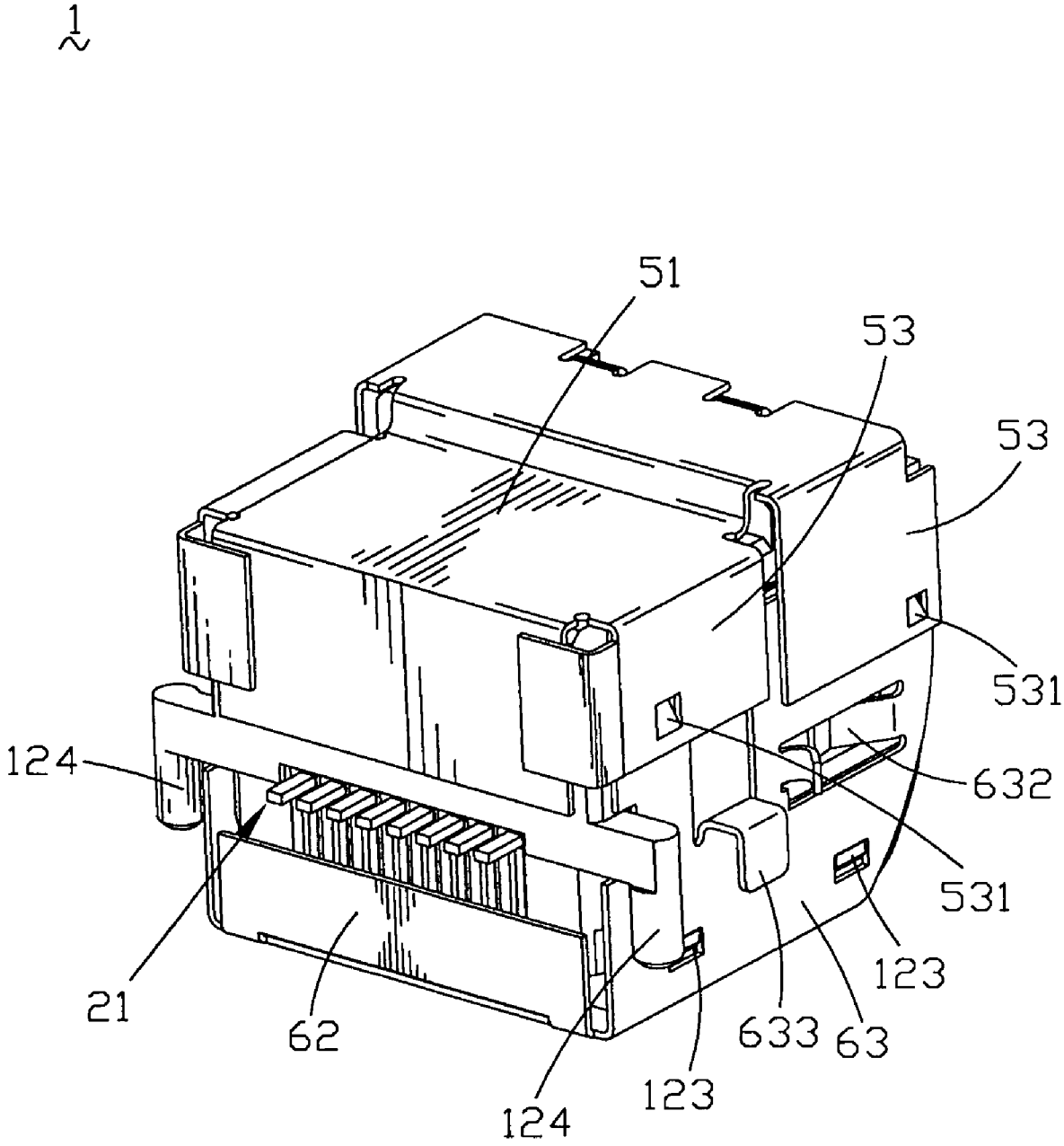
FIG. 7 is a perspective view of the receptacle connector.

Further referring to FIGS. 3 to 7, while the receptacle connector 1 is assembled, the fixing portion 211 of the terminals 21 are received in the terminal channels 253 of the upper board 251. The locating projections 212*a*, 212*b* are respectively fixed in the locating cavity 253 of the upper board 251 (as shown in FIG. 3). The holding portion 214 passes through the breaches 257 of the upper board 251. Then, the lower board 252 is covered to the upper board 251 with the pillars 255 respectively inserting into the locking holes 256. So, the terminal module 20 is assembled (as shown in FIG. 4). Then, the terminal module 20 is inserted into the receiving cavity 141 with the inserting portion 258 inserting into the inserting cavity 142 of the body 10. The contacting portion 213 of the terminal 21 locates in the receiving space 11. The holding portion 214 of the terminal 21 is received in the terminal holes 131 of the body 10 with the soldering portion 215 of the terminal 21 stretching out for being soldered to the external PCB. The pressing pins 70 are fixed in the trapezoid hole 121 of the body 10 with the pressing plane 72 stretching into the receiving space 11. Then, the bottom cover 60 is covered outside the body 10. The pressing pieces 632 of the bottom cover 60 stretch into the receiving space 11 through the oblong hole 122 of the body 10. The second fixing hole 634 of the bottom cover 60 is fixed in the fixing lumps 123 of the body 10. As shown in FIG. 7, the back board 62 of the bottom cover 60 presses forwardly against the pedestal 25 for preventing the terminal module 20 sliding out of the body 10. Then, the top cover 50 is covered. The locking piece 531 of the top cover 50 locks the first fixing hole 631 of the bottom cover 60.

Through the assembling mechanism of the terminals, this invention changes the conventional method of insert-mold type to assembling type while the terminals 21 is fixed in the body 10. Furthermore, for having the same mechanism, the upper board 251 and the lower board 252 may come from the same mold which also simplify the producing machines.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A receptacle connector comprising:

a body defining a receiving cavity in a bottom of said body; and a terminal module, received in said receiving cavity, having a plurality of terminals, and a pedestal further comprising an upper board and a lower board respectively defining a plurality of terminal channels, wherein each of said terminals has a fixing portion received in a corresponding one of said terminal channels to form said terminal module, said fixing portion having a straight portion and a plurality of locating projections extending from said straight portion, at least two of said locating projections extending from said straight portion in opposite directions, said straight portion being substantially parallel to an upper surface of said lower board.

2. The receptacle connector as claimed in claim 1, further comprising a pair of inserting portion defined in sides of said pedestal, and a pair of inserting cavities defined in said body on sides of said receiving cavities for receiving said inserting portion.

3. The receptacle connector as claimed in claim 1, wherein a plurality of locating cavities extend from said corresponding one of said terminal channels for respectively receiving said locating projections.

4. The receptacle connector as claimed in claim 1, wherein said fixing portion of each of said terminals extends upwardly from one end of said straight portion to form a holding portion substantially perpendicular to said straight portion; and said upper board defines a breach in a rear portion of each of the terminal channels for allowing the holding portions to pass through.

5. The receptacle connector as claimed in claim 4, further comprising a soldering portion extending from a top of said holding portion;

a contacting portion extending backwardly from another end of said straight portion;

a receiving space defined in said body for receiving an external plug connector; and a back wall, defined in back of said body, defining a plurality of terminal holes for receiving said holding portions of said terminals;

wherein said soldering portion of said terminal stretches out of said terminal hole;

said contacting portion of said terminal stretches through said terminal hole locating in said receiving space.

6. The receptacle connector as claimed in claim 1, further comprising a plurality of pillars and a plurality of locking holes in opposite surfaces of said upper and lower board, wherein said pillars are respectively inserted into said locking holes for locking said upper and lower board together to further form said pedestal.

7. The receptacle connector as claimed in claim 6, wherein said upper board has the same mechanisms with said lower board, and is an overturning of said lower board.

8. The receptacle connector as claimed in claim 1, wherein said locating projections are in contact with said upper surface of said lower board and a lower surface of said upper board.

9. The receptacle connector as claimed in claim 1, wherein said upper surface of said lower board has a divider located between two adjacent locating projections, said two adjacent locating projections being of two adjacent terminals respectively.

10. The receptacle connector as claimed in claim 1, wherein said at least two of said locating projections is spaced apart by an interval along a direction of said terminal channel.

* * * * *